US007667140B2

(12) United States Patent
Hock et al.

(10) Patent No.: US 7,667,140 B2
(45) Date of Patent: Feb. 23, 2010

(54) CABLE INCLUDING HELICALLY TWISTED CONDUCTORS

(75) Inventors: Thomas Hock, St. Georgen (DE); Klaus Holterhoff, Olpe (DE); Jens Oesterhaus, Detmold (DE); Stephan Fehling, Lage (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 233 days.

(21) Appl. No.: 11/891,330

(22) Filed: Aug. 11, 2007

(65) Prior Publication Data

US 2008/0047734 A1 Feb. 28, 2008

(30) Foreign Application Priority Data

Aug. 24, 2006 (DE) ..... 10 2006 039 604

(51) Int. Cl.
*H01B 7/08* (2006.01)

(52) U.S. Cl. ..... 174/117 F

(58) Field of Classification Search ..... 174/117 F, 174/112

See application file for complete search history.

(56) References Cited

U.S. PATENT DOCUMENTS

| | | | | |
|---|---|---|---|---|
| 4,034,148 | A | 7/1977 | Lang | |
| 4,472,598 | A * | 9/1984 | Boyd et al. | 174/113 R |
| 4,641,904 | A * | 2/1987 | Kosugi et al. | 439/404 |
| 4,990,098 | A * | 2/1991 | Neidecker et al. | 439/207 |
| 5,182,466 | A | 1/1993 | Ohkubo | |
| 5,483,020 | A | 1/1996 | Hardie | |
| 5,606,151 | A | 2/1997 | Siekierka | |
| 5,973,268 | A * | 10/1999 | Cheng | 174/112 |
| 6,270,598 | B1 | 8/2001 | Kasahara | |
| 6,412,265 | B1 | 7/2002 | Yamamoto | |
| 6,476,329 | B2 | 11/2002 | Tsukomoto | |
| 6,972,375 | B2 * | 12/2005 | Sugaya et al. | 174/117 F |

FOREIGN PATENT DOCUMENTS

| | | | |
|---|---|---|---|
| DD | 279 335 | A1 | 5/1990 |
| DE | 17 54 975 | U | 7/1956 |
| DE | 35 27 847 | A1 | 2/1987 |
| DE | 38 90 470 | C2 | 12/1988 |
| DE | 38 89 982 | T2 | 1/1989 |
| DE | 689 09 192 | T2 | 6/1990 |
| DE | 197 17 216 | A1 | 10/1998 |
| DE | 101 57 678 | C2 | 6/2003 |
| DE | 20 2005 010 039 | | 10/2005 |
| DE | 10 2005 041 892 | A1 | 3/2007 |
| WO | WO 01/08167 | A1 | 2/2001 |

* cited by examiner

*Primary Examiner*—Chau N Nguyen
(74) *Attorney, Agent, or Firm*—Lawrence E. Laubscher, Sr.; Lawrence E. Laubscher, Jr.

(57) ABSTRACT

A cable includes a cable sheath in which are embedded a plurality of insulated conductors at least two of which are helically twisted, the cable being provided with visible markings that indicate where one can electrically engage a selected one of the conductors by an insulation-piercing contact. The cable is formed by arranging a plurality of insulated conductors in a light-transmitting synthetic plastic sheath layer, two or more of the insulated conductors being helically twisted about a longitudinal axis, which cable is optically scanned to determine locations at which contiguous portions of the twisted insulated conductors are superposed orthogonally relative to a reference plane, whereupon markings are formed on the cable sheath layer at locations laterally spaced from the contiguous conductor portions, whereby a selected one of the twisted conductors may be engaged by an insulation-piercing contact.

7 Claims, 7 Drawing Sheets

CABLE INCLUDING HELICALLY TWISTED CONDUCTORS

BACKGROUND OF THE INVENTION

1. Field of the Invention

An electrical cable includes a light-transmitting cable sheath in which are embedded a plurality of insulated conductors at least two of which are helically twisted, the cable being provided with visible markings that indicate where one can electrically engage a selected one of the twisted conductors by an insulation-piercing contact, together with a method for manufacturing such a cable.

2. Description of Related Art

Electrical cables, especially flat-strip cables that have parallel and/or mutually twisted-together conductors (the latter by way of the so-called "twisted-pair technology") are known as such. The following are furthermore cited with regard to the state of the art: German patent No. DE 38 90 470 C2, and the U.S. Pat. Nos. 6,270,598, 5,606,151 and 6,476,329.

A special problem connected with these cables occurs during the contacting of the conductors that are twisted together with each other by means of insulation-penetrating contacts, which must contact the mutually twisted-together conductors at precise spots that are suitable for this purpose. These can, for example, be places where the conductors lie next to each other in the cable plane or orthogonally relative to the cable plane above each other. The parallel sides likewise are not always positioned in a defined manner with respect to each other so that they are not always securely retained.

To solve this problem, it has been proposed in the U.S. Pat. No. 6,476,329 to eliminate the twisting of the conductors over a predetermined longitudinal extent and that one can contact the conductors in this area by means of insulation-penetrating contacts. But that makes the production of the cable more expensive. Besides, the elimination of the twisting over a predetermined area does not have an advantageous effect on signal transmission with the cable. It is therefore desirable to create a cable with continuously twisted conductors.

In the Yamamoto U.S. Pat. No. 6,412,265, an insulation-penetrating cable is disclosed wherein the cable sheath contains perforations. But these perforations are regularly distributed over the cable sheath and are not so fashioned that they can be used as markings or that they will represent such markings because they do not permit the alignment of the insulation-penetrating contacts in such a manner that the twisted conductors will be contacted at the appropriate places. This applies all the more since the twisting into the longitudinal cable direction is not quite constant so that the markings are not to be arranged entirely in a precise grid, but rather preferably are placed exactly where the optimum point for contacting the conductors is or was determined in each case.

The present invention was developed to correct this problem and to develop the typical cable in such away that it will be possible to provide for the secure contacting of conductors and especially also—if present—of the twisted conductors with insulation-penetrating contacts, in particular, insulation-piercing contacts. Furthermore, a process is to be provided for the production of the cable as well as a connecting device for the purpose of contacting the invention-based cable.

SUMMARY OF THE INVENTION

Accordingly, a primary object of the present invention is to provide an electrical cable including a cable sheath formed from a light-transmitting synthetic plastic material in which are embedded a plurality of insulated conductors at least two of which are helically twisted, the cable being provided with visible markings that indicate where one can electrically engage a selected one of the twisted conductors by an insulation-piercing contact.

Another object of the invention is to provide a method for manufacturing a cable having a plurality of insulated conductors arranged in a light-transmitting synthetic plastic sheath layer, two or more of the insulated conductors being helically twisted about a longitudinal axis, which cable is optically scanned to determine locations at which contiguous portions of the twisted insulated conductors are superposed orthogonally relative to a reference plane, whereupon markings are formed on the cable sheath layer at locations that are laterally spaced from the contiguous conductor portions, whereby a selected one of the twisted conductors may be engaged by an insulation-piercing contact.

The markings make it possible in a simple manner to set the insulation-penetrating contacts or a superimposed connecting device with at least one insulation-penetrating contact at the right place. But it is impossible to set them within a fixed grid. The invention solves this in the following manner: The cable sheath consists of a transparent, in particular, translucent material. That measure, of course, is known as such. But there is one thing that was not recognized, and that was the advantage due to the fact that it is particularly simple to use this measure in order to attach automated markings upon the cable. The concept of translucency furthers makes it possible in a simple fashion also to investigate other properties, for example, the parallelism of the cable's conductors in order, for example, to make sure that one can contact a particularly suitable case on the cable where the conductors are arranged exactly with respect to each other as predetermined.

In particular, the markings are put in places upon which conductors that are twisted together with each other—especially continually—can be contacted in the twisted area with IDC contacts. Moreover, optimum places for IDC contacting are also determined and marked on cables with only parallel conductors. In other words, the markings are found in places that have a previously known—for example, constant—interval with respect to the places that are to be contacted with the piercing contacts.

Preferably, the cable sheath consists of a material that can become translucent as a result of a light source. It is practical when the markings are made as easily located penetrations or impregnations in the cable sheath. This variant of the invention is advantageously supplemented by a connection device for contacting the mutually twisted-together conductors of a cable, which has a device for the alignment upon the markings of the cable. This, for example, may in the simplest fashion involve a projection for the purpose of engaging in a penetration or an outward configuration that constitutes the marking.

Preferably, the marking is located directly to the side (i.e., normal to the X longitudinal direction) next to the place that is to be contacted. The marking, however, can also be positioned somewhat offset in the longitudinal direction of the cable if this is accordingly considered in the design of the connection device. The important thing is that the projection will so engage the marking that the insulation-penetrating contact will be correctly alignment for the purpose of contacting the twisted-together conductors.

When several twisted-together conductor pairs are provided, then one can accordingly possibly also provide several—for example, different—markings for each twisted-together conductor pair.

Now one can provide one marking each in the longitudinal direction for each complete spiral loop (twisting over 360°).

Preferably, the markings are arranged in the longitudinal direction of the cable next to places on the cable where the mutually twisted-together conductors are to be contacted by the insulation-penetrating contacts. As a rule, these are the areas where the mutually twisted-together conductors in the direction of the movement of the insulation-penetrating contacts are flush with each other.

The invention also creates a process for the production of a cable involving the following: From a prefabricated cable—preferably with at least one pair of parallel conductors and/or mutually twisted-together conductors—one determines at which places possibly the parallel conductors or possibly—that is to say, when they are there—the mutually twisted-together conductors can be contacted with the insulation-penetrating contacts, whereby the cable or the cable sheath, preferably at these points or in the area of these points, is provided with markings. For this purpose, by the way, the prefabricated cable is transversely illuminated by means of a light source that can be moved with relation to the cable, whereby with the help of a likewise relatively movable sensor on the other side of the cable sheath, one can determine the places where the parallel or twisted-together conductors can be contacted by means of insulation-penetrating contacts and whereby the cable or its sheath is provided with markings at which the particular insulation-penetrating contact or a corresponding connection device for contacting can be aligned. This method is easy to implement and can also be done in an automated fashion. According to the state of the art, no process was known for being able to place markings on cables, for example, for designating spots on twisted-together conductors in a cable sheath that would be suitable for contacting, although, as such, there were thoughts of applying such markings on the cable. The concept, however, could not be expressed in the form of an automated procedure because the interval of the suitable places in the cable sheath, as a rule, are not so constant that one can attach the markings simply in a fixed grid pattern. This problem can now be solved according to the present invention.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
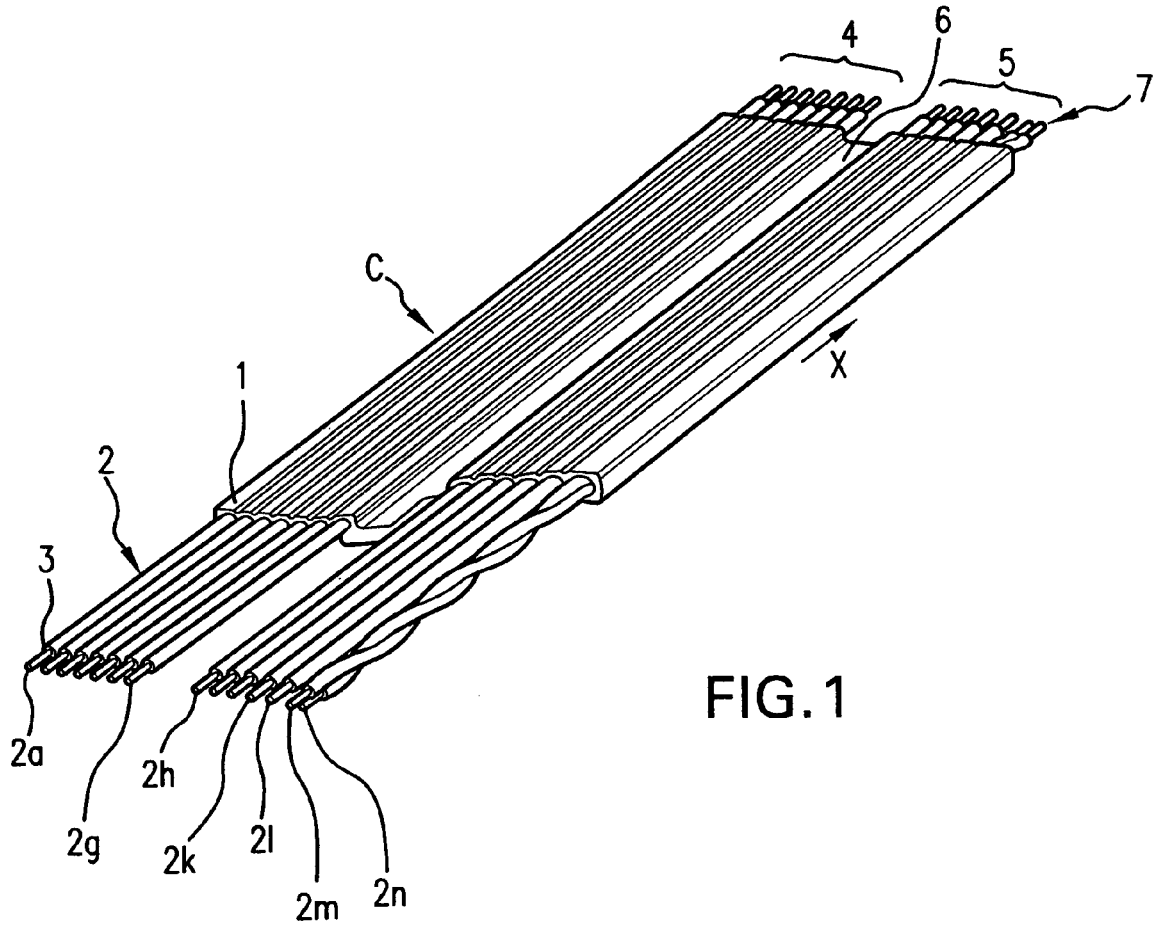
FIG. 1 is a perspective view of the cable of the present invention when in the initial unmarked condition.

Referring first more particularly to FIG. 1, the cable C includes a cable sheath 1 that encloses a plurality of conductors 2 which are each provided with an outer insulation layer 3. The cable is made in the form of a flat-strip cable that has fourteen conductors 2*a* to 2*n*. This number is to be understood just as an example and can be varied within the context of the invention. The diameters of the conductors 2 of the cable can be equal or also different.

Conductors 2*a* to 2*n* here are grouped in two groups 4, 5 with seven conductors each 2*a* to 2*g* and 2*h* to 2*n*, whereby between the two groups there is an interval that goes beyond the distance of conductors 2 within the groups 4, 5, which interval is bridged by a cable sheath strip 6. A first group of four conductors 2*a* to 2*g* are placed parallel to each other. In the second group of conductors 2, the five conductors 2*h* to 2*l* lie parallel to each other. Conductors 2*k* and 2*m* have a larger diameter than conductors 2*a* to 2*j*. At least two of the conductors—the conductors 2*m*, 2*n*—moreover, are twisted together with each other (twisted pair), whereby this twisted unit 7 again as a whole is arranged parallel to the other conductors.

It is first of all essential to make sure that at least two of the conductors 2 of the cable are twisted together with each other. As an alternative, one could also arrange in the cable several twisted-together conductor pairs, preferably in one plane next to each other (now shown here). Moreover, it might also be conceivable to twist more than two conductors together with each other.

Figure 8:
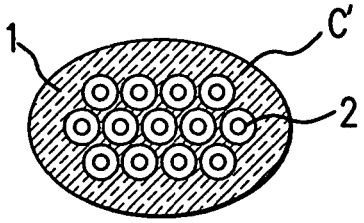
FIGS. 8 and 9 are sectional views of two modifications of the cable of the present invention.
Figure 9:
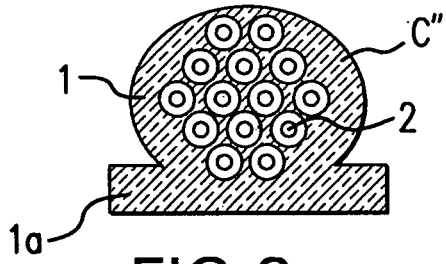

The cable here has a particularly preferred flat-strip cable shape. Alternate shapes are conceivable, for example, especially generally flat cables C' having an elliptical cross-sectional configuration (FIG. 8). When round cables C" are used (FIG. 9), it is recommended to provide a polarization means, such as a radially outwardly directed integral web portion 1*a* on the outer sheath 1, thereby to provide a reference plane relative to the cable. In each case, the cable sheath 1 consists of a transparent or translucent material, something that is illustrated, for example, in FIGS. 4 to 7.

Figure 3:
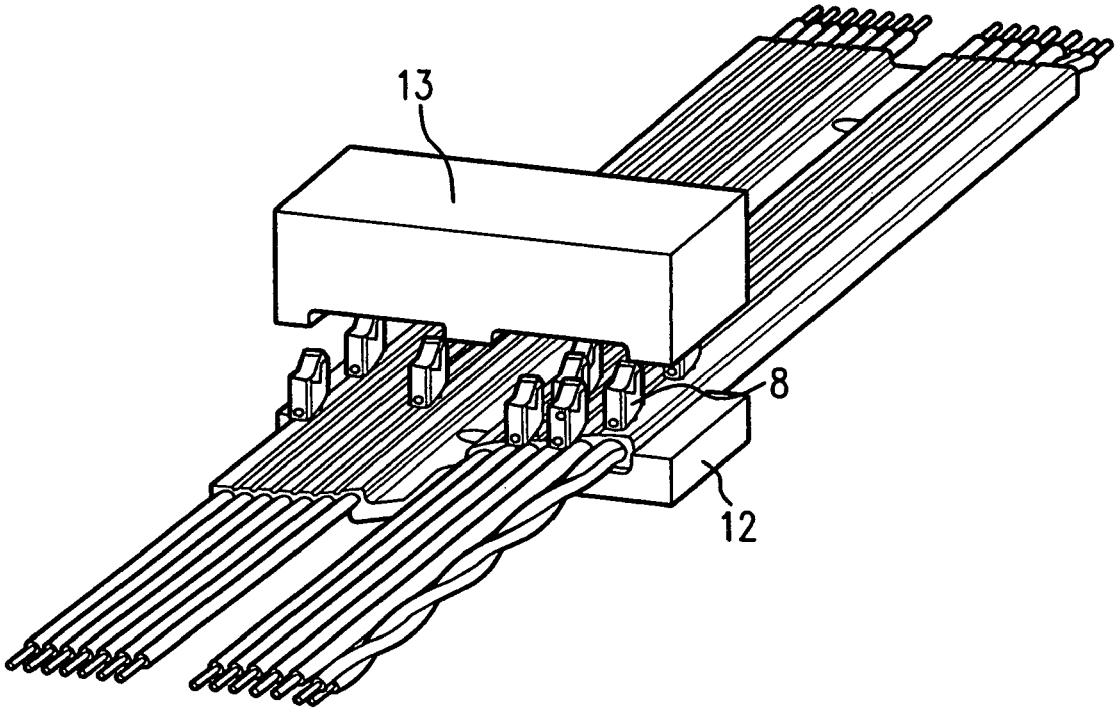
FIG. 3 is a corresponding perspective view illustrating the manner of penetration of the cable by the insulation piercing means.
Figure 4A:
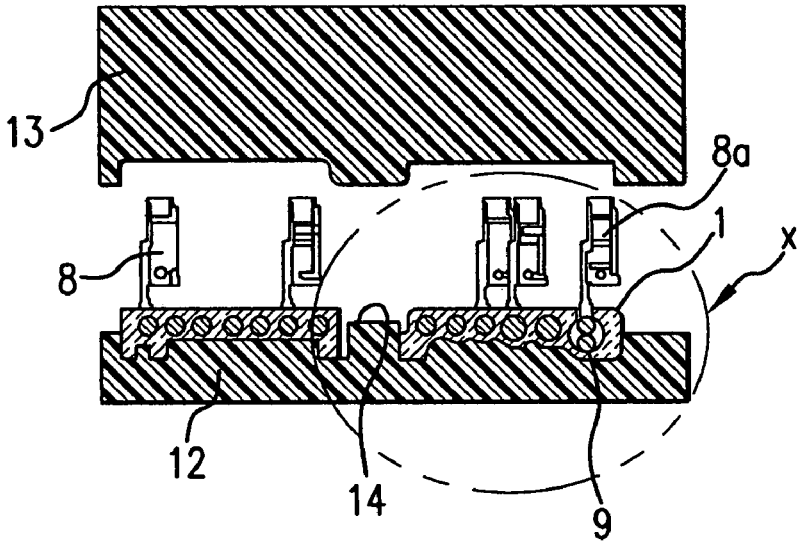
FIG. 4*a* is a sectional view taken along the line 4*a*-4*a* of FIG. 3.
Figure 4B:
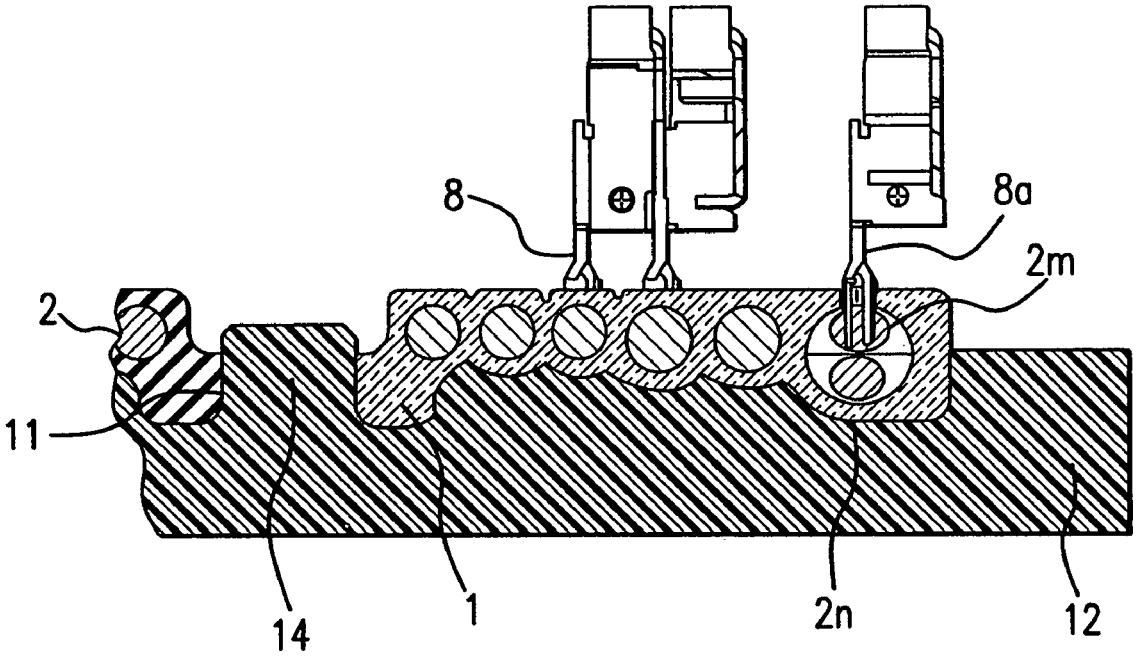
FIG. 4*b* is an enlargement of the circled portion of FIG. 4*a;*
Figure 5:
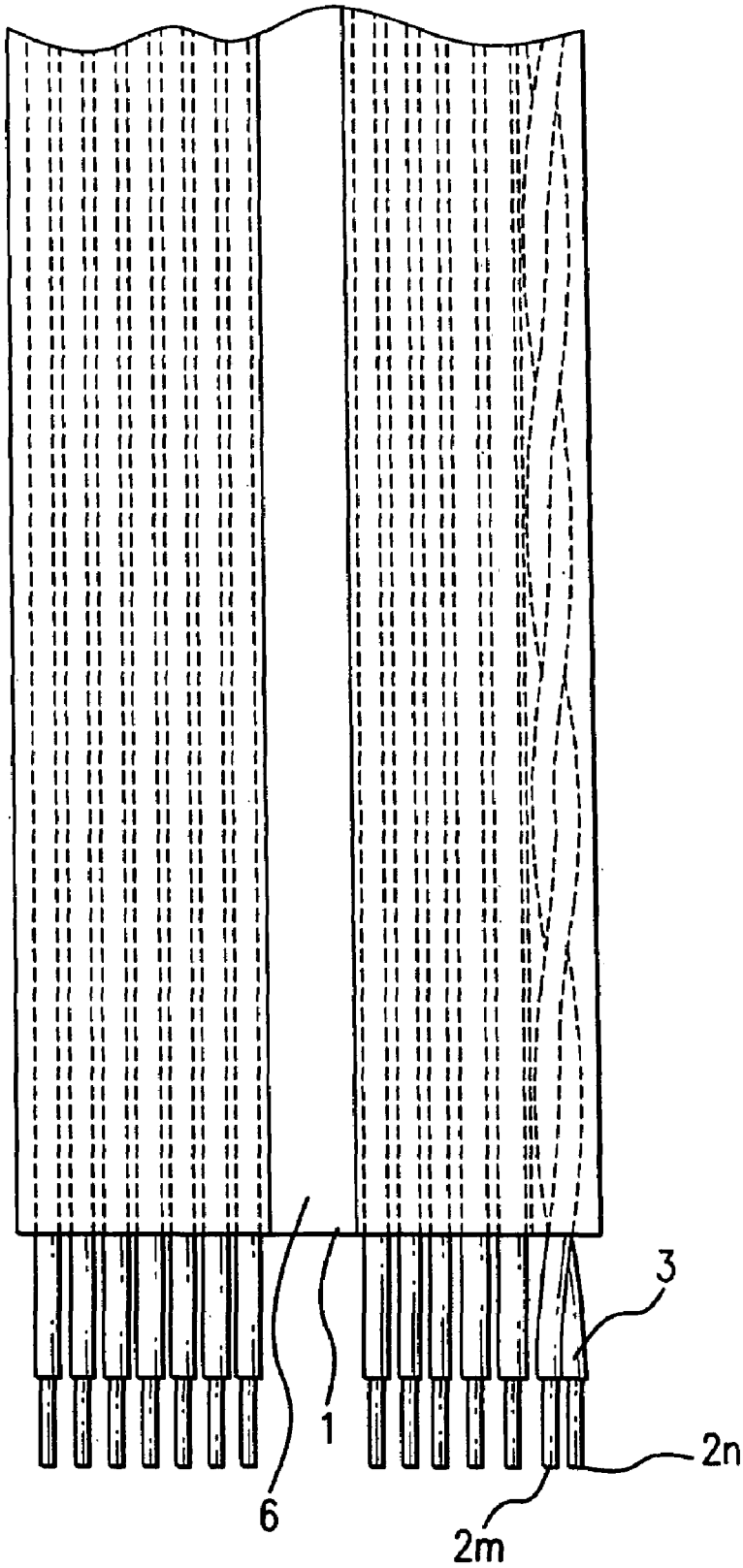
FIGS. 5, 6 and 7 are top plan views of the cables of FIGS. 1, 2 and 3, respectively.
Figure 6:
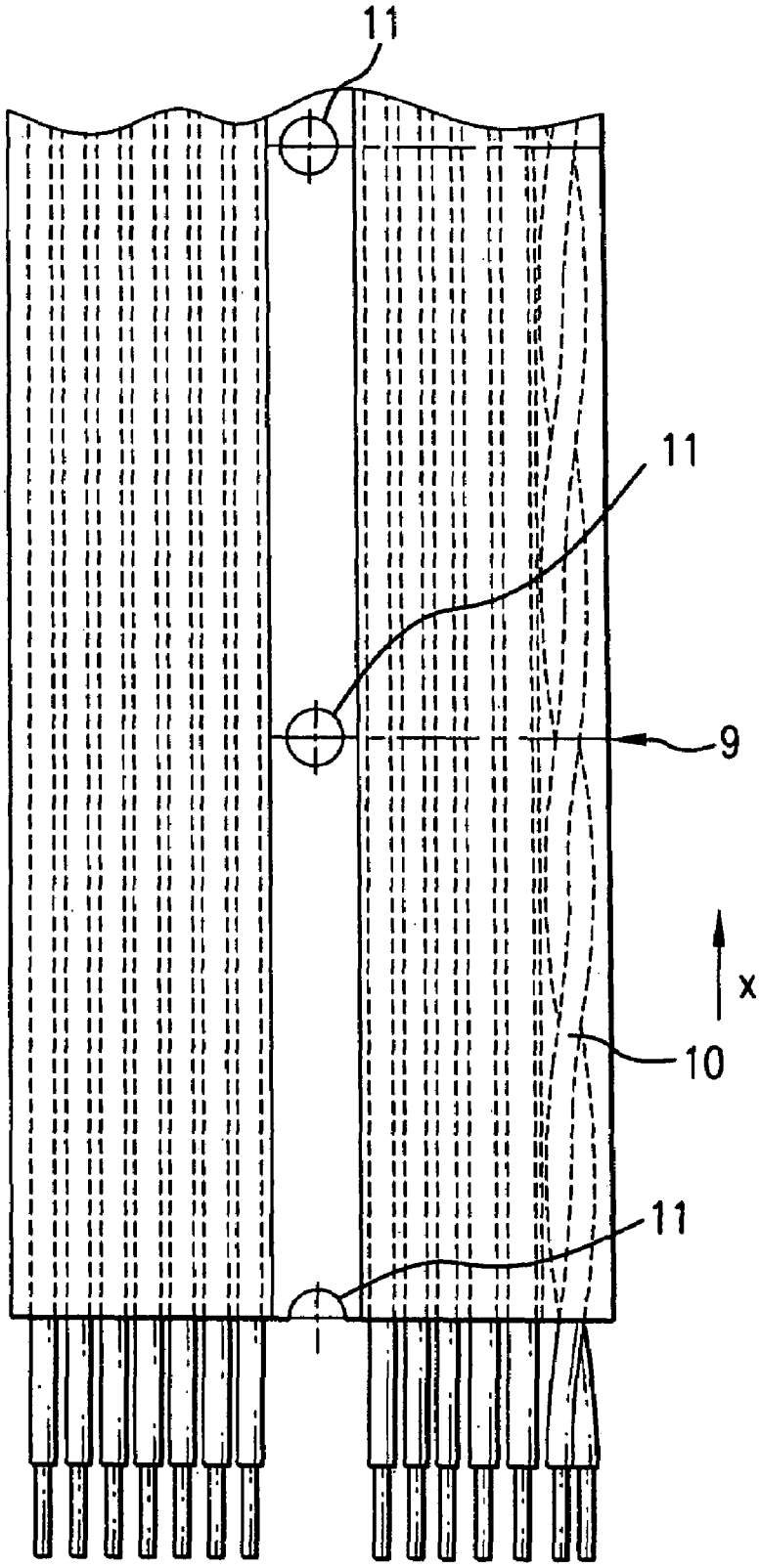
Figure 7:
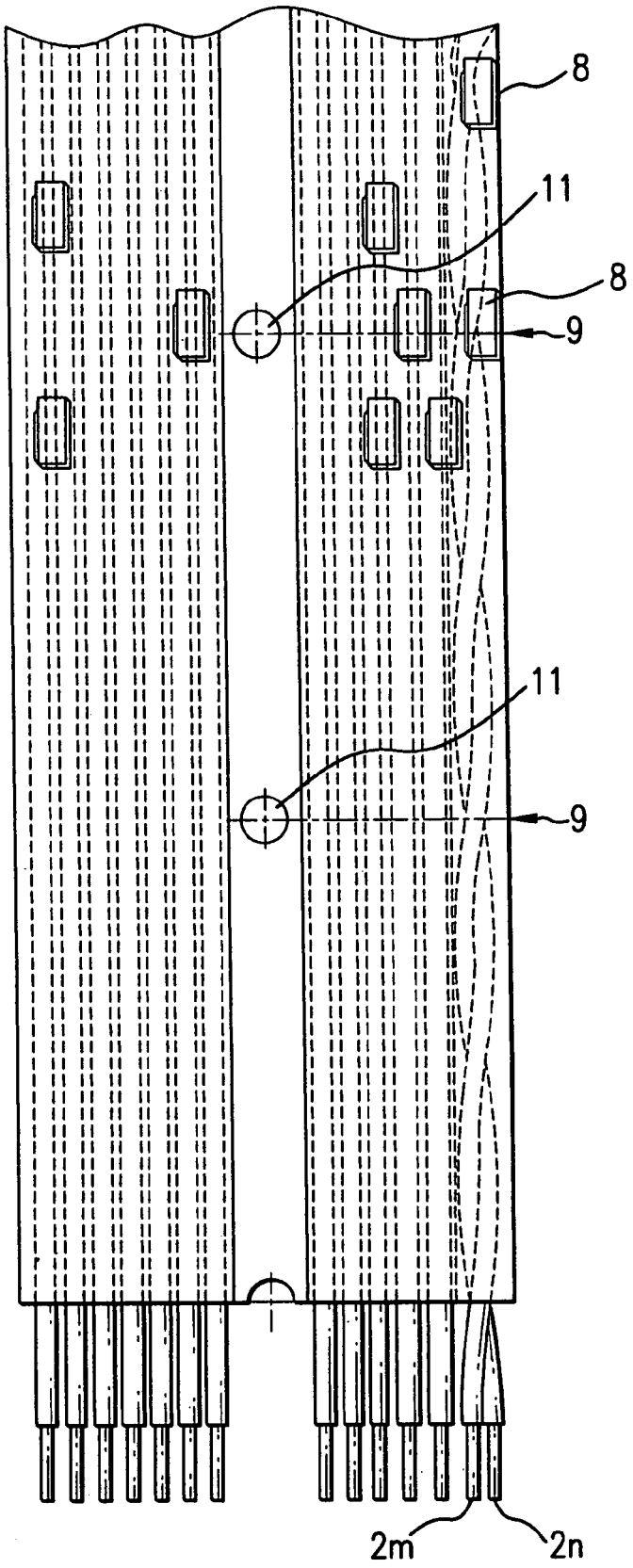

Cable C in FIG. 1 is subjected to a last finishing step to be able to contact not only conductors 2*a* to 2*l* but also the mutually twisted-together conductors 2*m*, 2*n* by means of insulation-penetrating contacts (IDC contacts) 8 (FIG. 3, FIG. 7). One now first of all determines at which places the mutually twisted-together conductors 2*m*, 2*n* can be contacted with the insulation-penetrating contacts. As a rule, that will be the places 9 or 10 that are arranged with relation to the direction of movement of the insulation-penetrating contacts and that are either flush with each other or that are arranged next to each other. At the desired places, cable sheath 1 is then provided once or preferably, in the area of each spiral, with markings 11.

Here it is desirable to contact the mutually twisted-together conductors 2*m*, 2*n* at those places where they are positioned above each other normal to the reference plane of the cable. These are the places 9 where the conductors 2*m*, 2*n* are flush with each other in the direction of the movement of the IDC contacts 8. Then the places 9, which are to be contacted later on, are in each case provided with at least one of the markings 11.

Figure 2:
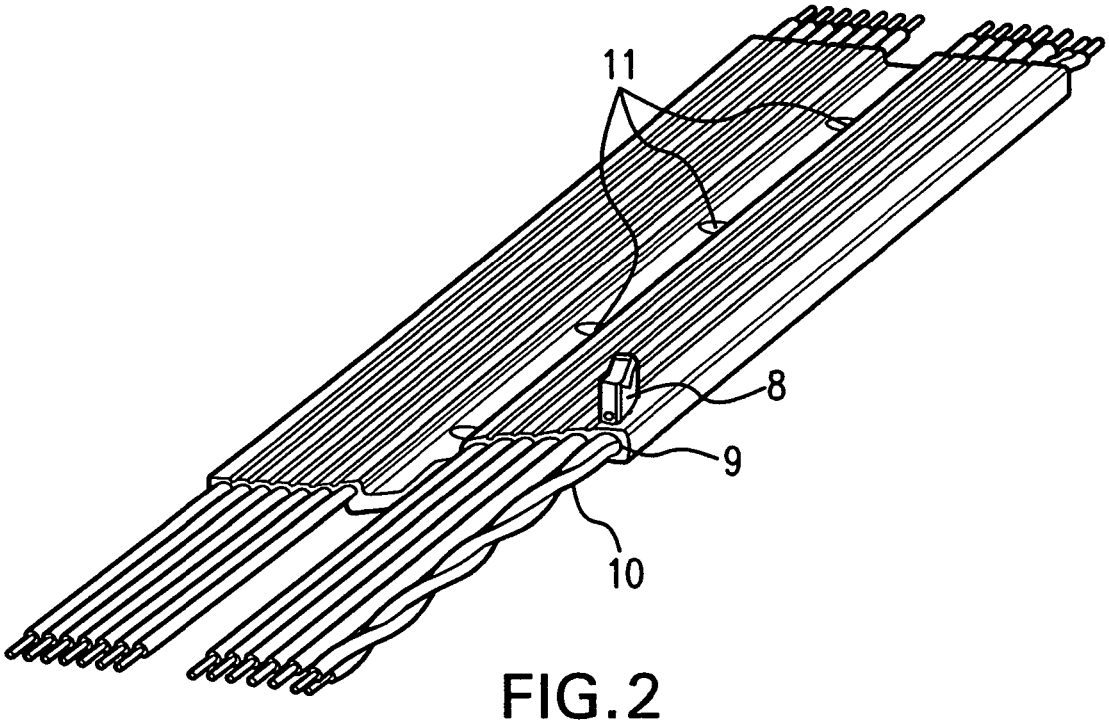
FIG. 2 is a corresponding view of the cable of FIG. 1 when provided with markings illustrating the penetration locations for the insulation-piercing contacts.

Markings 11 are easily recognizable in the preferred exemplary embodiment and are clearly shaped in the middle cable sheath strip 6 as penetrations (FIG. 2). It is, however, basically also conceivable to put markings of some other kind on the cable sheath. The important thing is that the markings 11 must be in a fixed relation to the spiral arrangement and the alignment of the mutually twisted-together conductors 2*m*, 2*n*. Here one might mark the places that are to be contacted with the insulation-penetrating contacts or areas of the cable in the latter's X longitudinal direction, something that is particularly clearly visible in FIG. 7. Here markings 11 are placed laterally opposite contact place 9 in the cable sheath strip 6.

The marking is preferably done automatically by means of a device for the transverse illumination of the cable, whereby the cable, for example, is transversely illuminated from one side with a light source that can be moved with relation to the cable. With the help of a likewise relatively movable sensor, one determines on the other side of the cable when the conductors 2*m*, 2*n* are directly above each other. That is possible because the light falling into the sensor depends on whether the two twisted-together conductors are positioned above each other or next to each other. The marking is set when a maximum of light incidence has been determined.

The contacting is preferably done by means of a connection device with a preferably producible housing 12, 13 and with the IDC contacts 8 (preferably piercing contacts), which, for example, can be attached to the lid. Housing 12, 13 is aligned on one of the markings 11. For example, it is conceivable that the lower part of the housing 12 has a projection 14 that is so aligned as to engage the penetration that forms markings 11 so that the correct alignment of the connection device 8 will be ensured, so to speak, "automatically" during the contacting of the cable (FIG. 7). Thus, when the projection 14 extends within a perforation 11 (FIG. 4*b*), the insulation-piercing contact 8*a* engages the conductor 2*m*. At another longitudinally-spaced location between the markings 11, the conductor 2*n* is arranged uppermost for engagement by an insulation-piercing contact.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical cable (C) comprising:

(a) a plurality of insulated conductors each including an electrical conductor (2) enclosed by a layer of insulation material (3); and (b) a cable sheath layer (1) enclosing said insulated conductors, said cable sheath layer being formed from a light-transmitting synthetic plastic material, (c) at least two of said insulated conductors (2*m*, 2*n*) being helically twisted together within said cable sheath layer, thereby to define within said cable sheath layer a plurality of characterizing insulation-piercing locations (9, 10) relative to the other insulated conductors;

(d) said cable sheath layer containing a plurality of longitudinally-spaced visible markings (11) arranged opposite at least some of said insulation-piercing locations, whereby a selected one of said twisted insulated conductors may be electrically engaged by an insulation-piercing contact (8) arranged at a corresponding one of said insulation-piercing locations.

2. An electrical cable as defined in claim 1, wherein said plurality of insulated conductors are divided into two groups one of which includes said helically twisted insulated conductors, said two groups of insulated conductors being joined by an intermediate strip portion (6) of said cable sheath layer, said visible markings being carried by said cable sheath layer intermediate strip portion.

3. An electrical cable as defined in claim 2, wherein said markings comprise perforations (11) contained in said intermediate strip portion.

4. An electrical cable as defined in claim 1, wherein one marking is provided for each longitudinal 360° helical turn of said at least two twisted insulated conductors.

5. An electrical cable as defined in claim 4, wherein said markings are provided at locations opposite positions at which the same twisted insulated conductor is superposed over the companion twisted insulated conductor.

6. An electrical cable as defined in claim 1, and further including means defining a longitudinal reference plane relative to said at least two twisted insulated conductors, said insulation-piercing locations (9, 10) being defined by locations at which contiguous portions of said twisted insulated conductors are superposed orthogonally relatively to said reference plane.

7. An electrical cable as defined in claim 6, wherein said cable (C) is flat, all of said insulated conductors being contained in a plane that defines said reference plane.

* * * * *